US007594859B2

(12) United States Patent
Mullen

(10) Patent No.: US 7,594,859 B2
(45) Date of Patent: Sep. 29, 2009

(54) ILLUMINATED GOLF CUP

(76) Inventor: Nate Mullen, 1240 Simpson Way, Escondido, CA (US) 92029

( * ) Notice: Subject to any disclaimer, the term of this patent is extended or adjusted under 35 U.S.C. 154(b) by 0 days.

(21) Appl. No.: 12/025,983

(22) Filed: Feb. 5, 2008

(65) Prior Publication Data

US 2009/0197691 A1 Aug. 6, 2009

(51) Int. Cl.
*A63B 57/00* (2006.01)

(52) U.S. Cl. ..... 473/176; 473/175

(58) Field of Classification Search ..... 473/174–179
See application file for complete search history.

(56) References Cited

U.S. PATENT DOCUMENTS 3,918,719 A * 11/1975 Welch ..... 473/409
5,354,052 A * 10/1994 Nicholls et al. ..... 473/192
5,445,373 A * 8/1995 Franks ..... 473/409
5,685,780 A * 11/1997 Desjardins ..... 473/178
6,699,137 B2 * 3/2004 Szymanski ..... 473/169
7,033,280 B2 * 4/2006 Hottle et al. ..... 473/176
2008/0153614 A1 * 6/2008 Marshall ..... 473/158

* cited by examiner

*Primary Examiner*—Mark S Graham
(74) *Attorney, Agent, or Firm*—Kelly Lowry & Kelley, LLP

(57) ABSTRACT

An illuminated golf cup is internally lighted by a light source disposed within the cup. The light source is suspended in the bottom of the cup by being secured to the underside of an insert in the cup. The light source is directed upward from the bottom of the cup to cast light up and out of the cup. The light illuminates the opening of the cup and the flag in the cup, making the golf cup more visible from a distance and in low light.

17 Claims, 2 Drawing Sheets

ILLUMINATED GOLF CUP

FIELD OF THE INVENTION

The present invention relates to an apparatus for use on a golf course or in similar settings. In particular, the present invention is direct to an internally illuminated golf cup for use on golf greens or practice greens.

BACKGROUND OF THE INVENTION

There are a number of prior art devices that allow for illumination of a golf course or parts thereof, i.e., tee boxes, hazards, greens, driving ranges, putting greens, etc. Examples of such devices are described in publications such as the following:

WO/2007/038711—Illuminated Golf Flagpole—Richard J. Willett

U.S. Pat. No. 5,443,373—Night Golf System—Randy Franks

U.S. Pat. No. 6,575,842—Putting and Chipping Training Kit—David Tidwell

However, each of the devices disclosed in these publications suffer from a significant drawback. The golf cup or hole is either not directly illuminated or such illumination comes from above, usually by lights suspended above the green. Such illumination or lack thereof results in shadows cast over and around the hole, making it difficult for most golfers to clearly see the hole in low light.

Accordingly, there is a need for a device that provides better illumination of a golf cup on low light situations. The present invention fulfills these needs and provides further related advantages through the utilization of hydrodynamic cavitation and the chemical and physical reactions and process involved.

SUMMARY OF THE INVENTION

The present invention is direct to an illuminated golf cup. The inventive golf cup comprises a light source disposed within the golf cup for illuminating the golf cup from within. The golf cup may consist of an outer cylinder and a cup insert. The light source is disposed within the outer cylinder and below the cup insert.

The cup insert is preferably tapered to a central depression which acts as a flag pole support integral with the cup insert. The cup insert is designed to catch golf balls which go into the cup and keep the balls spaced a distance from the light source.

The light source is preferably sealed against moisture and other environmental hazards. The light source may be powered by an internal battery or an external power source. Where it is powered by an external power source, the light source will be electrically connected to that power source by electrical lead wires running under ground, i.e., golf green or putting green.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENTS

Figure 1:
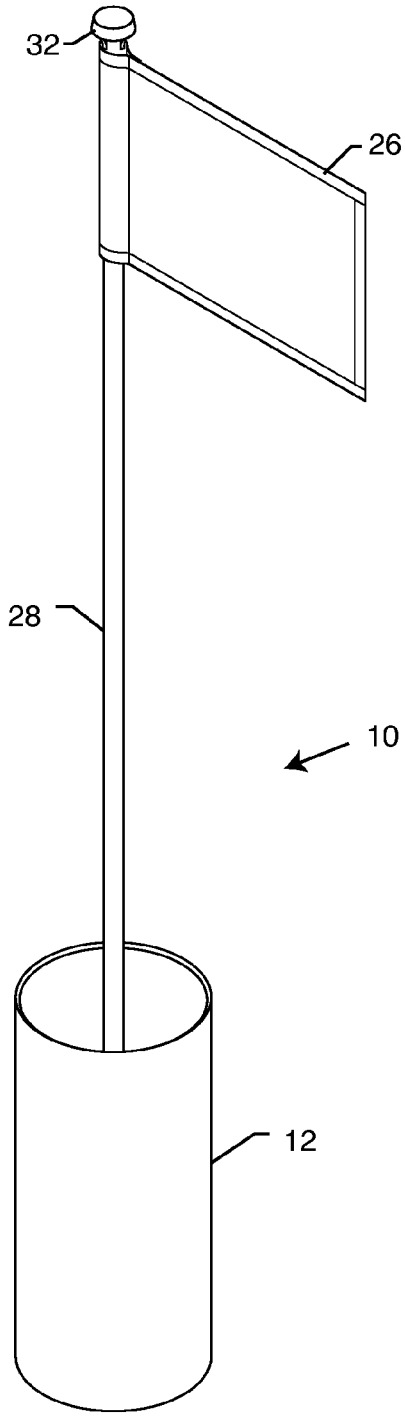
FIG. 1 is a perspective view of an illuminated golf cup embodying the present invention.

The present invention is directed to an internally illuminated golf cup. In FIGS. 1 through 4, the illuminated golf cup is generally referred to by reference numeral 10. In one preferred embodiment, the golf cup 10 generally consists of an outer cylinder 12, a tapered cup insert 14 and a light source 16.

The outer cylinder 12 forms a wall of the cup 10 and keeps a hole in the ground (not shown) from collapsing or otherwise releasing dirt or grass into the golf cup 10. Preferably, the outer cylinder 12 is manufactured from a polymer plastic, metal or other similar material used in golf cups. One may use any material for the outer cylinder 12 as long as it can reasonably withstand ordinary wear and tear associated with use on a golf course, as well as heat generated by the light source 16.

The cup insert 14 should be made out of the same or similar material as the outer cylinder 12. The same concerns about reasonably withstanding ordinary wear and tear associated with use on a golf course as well as heat generated by the light source 16 apply. The cup insert 14 is preferably constructed with an inward taper which results in a central depression 18. This central depression 18 includes a central opening or flag pole support 20.

The cup insert 14 is generally cylindrical in shape to match the shape of the outer cylinder 12 and fit within the same. A number of channels and grooves 22 around the perimeter provide a way of securing the cup insert 14 within the outer cylinder 12. These channels and grooves 22 engage protrusions (not shown) within the outer cylinder 12 and lock in place when twisted.

The cup insert 14 also includes a number of vented openings 24 around the central opening 20. These vented openings 24 provide a number of advantages. The vented openings 24 simulate the appearance of a standard golf cup insert which allows the inventive golf cup 10 to achieve the same or similar "drop sound" heard with prior art golf cups. The vented openings 24 also permit light and heat generated by the light source 16 to pass there through rather than be blocked or build-up within the golf cup 10.

Figure 2:
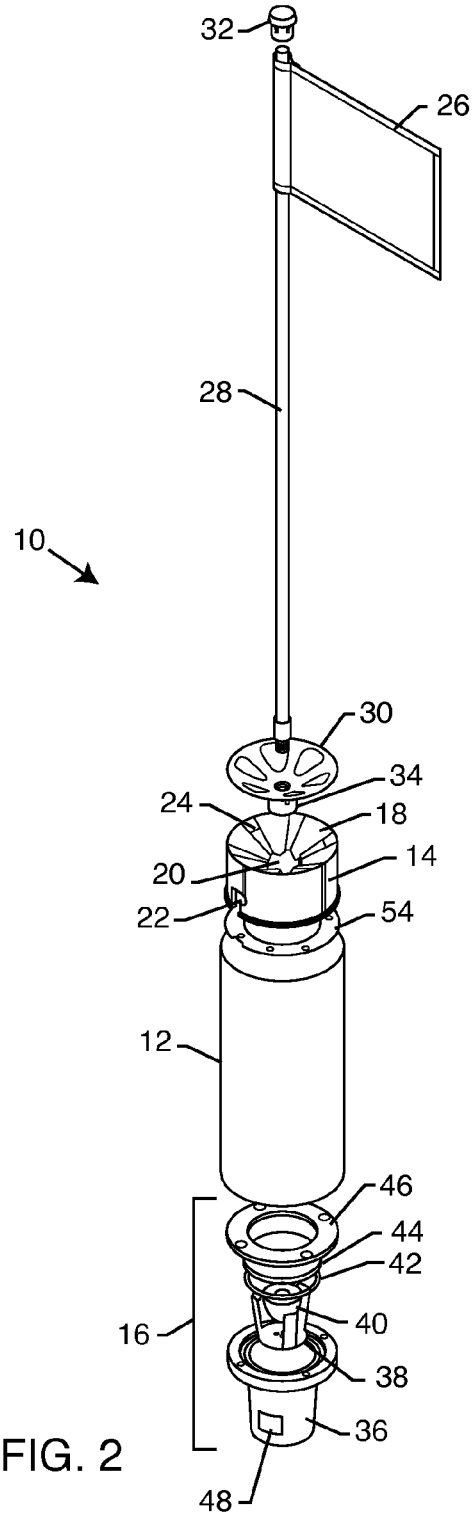
FIG. 2 is an exploded perspective view of an illuminated golf cup embodying the present invention.
Figure 3:
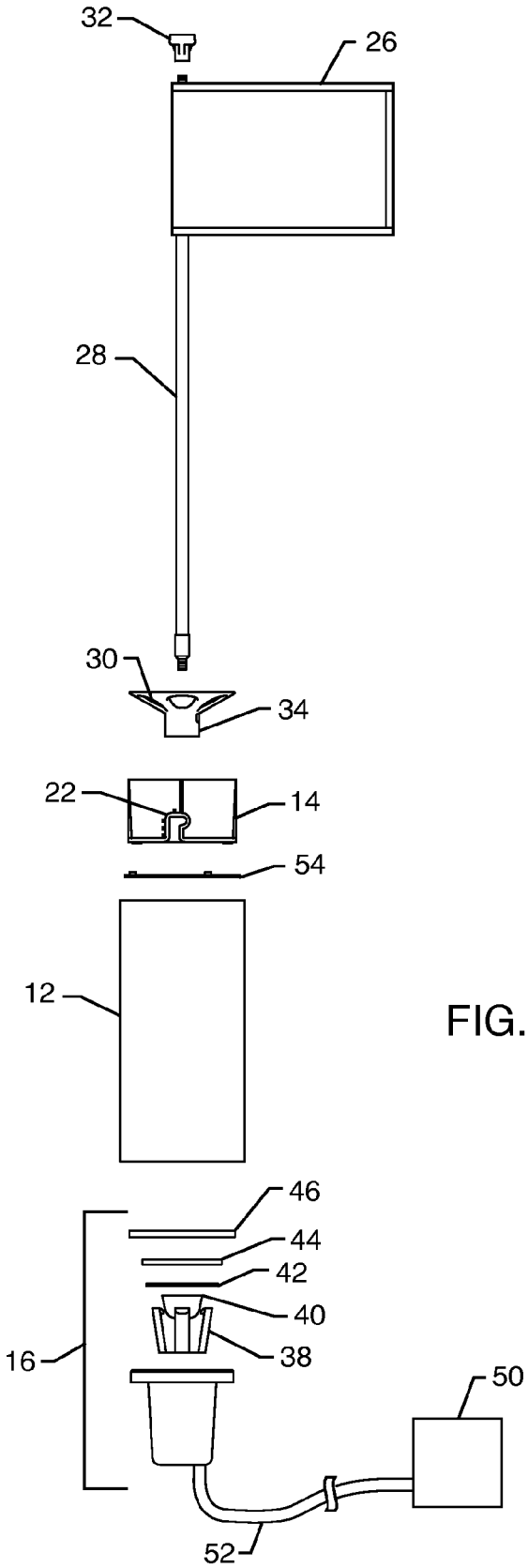
FIG. 3 is an exploded lateral view of an illuminated golf cup embodying the present invention.
Figure 4:
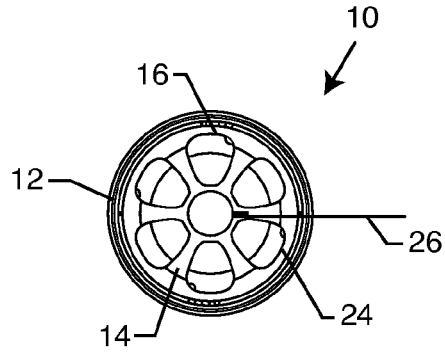
FIG. 4 is a top view of an illuminated golf cup embodying the present invention.

The central opening 20 is also intended to support a flag 26. The flag 26 preferably includes a flag pole 28, a pole base 30 and a pole cap 32. The base 30 may be configured as a flattened conical member (as shown in FIGS. 2 and 3) to mirror the depression 18 of the insert 14 with a base plug 34 that fits snugly into the central opening 20. This embodiment would be useful on putting greens. Alternatively, the base 30 may be configured as a base plug without the flattened conical member (not shown). This embodiment would be useful on regular golf course greens.

The light source 16 preferably consists of a cylindrical metal base 36 which includes a holder 38 for a light bulb 40. With the holder 28 and light bulb 40 inserted into the base 36, an o-ring gasket 42 and a lens 44 cover the opening in the base 36. A sealing ring 46 is attached to the base 36. The sealing ring 46 is attached by screws or other commonly used method. The pressure exerted by the sealing ring 46 compresses the lens 44 against the o-ring 42 thereby sealing the light source 16 against moisture and other environmental hazards.

The light source 16 is preferably low voltage and may be powered either by an internal battery 48 (FIG. 2) or an external power source 50 (FIG. 3). In the first instance, the battery 48 would need to be replaced when its charge ran out. In the second instance, the external power source 50 would need to be connected to the light source 16 by electrical wires 52. The electrical wires 52 would need to be run under ground and enter the golf cup 10 from below so as not to interfere with the appearance of the green for golf cup 10.

A connection ring 54 is used to secure the light source 16 to the underside of the cup insert 14 by screws or other commonly used securing means. The light source 16 is positioned such that the light it casts is directed upward through the cup insert 14 and out of the cylinder 12. The cup insert 14 is secured to the outer cylinder 12 by channels and grooves 22 and the light source 16 is secured to the cup insert 14. The light source 16 is thereby suspended in the bottom of the outer cylinder 12 below the cup insert 14 and thereby illuminates the golf cup 10 from within.

Although several embodiments have been described in some detail for purposes of illustration, various modifications may be made without departing from the scope and spirit of the invention. Accordingly, the invention is not to be limited, except as by the appended claims.

What is claimed is:

1. An illuminated golf cup for a putting green, comprising:

an elongated, hollow outer cylinder made of polymer plastic having top and bottom openings;

a cylindrical cup insert removably secured within the outer cylinder and having a shape to match the shape of the outer cylinder, the cup insert being made of polymer plastic and including a plurality of vented openings disposed around a central opening;

a light source removably disposed in the outer cylinder beneath the cup insert, the light source comprising a cylindrical metal base having a shape to match the shape of the outer cylinder and including a light bulb and a light bulb holder, a lens, and an o-ring gasket to seal the light source against moisture; and a flag comprising a flag pole and a pole base, the pole base configured to engage the central opening of the cup insert through the top opening.

2. The illuminated golf cup of claim 1, wherein the cup insert further comprises a central depression formed by an inward taper and the pole base has a shape to mirror the central depression.

3. The illuminated golf cup of claim 1, further comprising a connection ring disposed between the cup insert and the light source, the connection ring securing the light source to the cup insert.

4. The illuminated golf cup of claim 1, wherein the light source is low voltage.

5. The illuminated golf cup of claim 1, wherein the light source includes an internal battery.

6. The illuminated golf cup of claim 1, wherein the light source is connected to an external power source by electrical wires run under the putting green and into the bottom opening of the hollow cylinder.

7. The illuminated golf cup of claim 1, wherein the cup insert and light source are disposed within the outer cylinder such that securing the cup insert within the outer cylinder suspends the light source above the bottom opening.

8. An illuminated golf cup for a putting green, comprising:

an elongated, hollow outer cylinder made of polymer plastic having top and bottom openings;

a cylindrical cup insert removably secured within the outer cylinder and having a shape to match the shape of the outer cylinder, the cup insert being made of polymer plastic, and including a plurality of vented openings disposed around a central opening and a central depression formed by an inward taper;

a light source removably disposed in the outer cylinder beneath the cup insert, the light source comprising a cylindrical metal base having a shape to match the shape of the outer cylinder and including a light bulb and a light bulb holder, a lens, and an o-ring gasket to seal the light source against moisture;

a connection ring disposed between the cup insert and the light source, the connection ring securing the light source to the cup insert; and a flag comprising a flag pole and a pole base, the pole base having a shape to mirror the central depression and configured to engage the central opening of the cup insert through the top opening.

9. The illuminated golf cup of claim 8, wherein the light source is low voltage.

10. The illuminated golf cup of claim 8, wherein the light source includes an internal battery.

11. The illuminated golf cup of claim 8, wherein the light source is connected to an external power source by electrical wires run under the putting green and into the bottom opening of the hollow cylinder.

12. The illuminated golf cup of claim 8, wherein the cup insert and light source are disposed within the outer cylinder such that securing the cup insert within the outer cylinder suspends the light source above the bottom opening.

13. An illuminated golf cup for a putting green, comprising:

an elongated, hollow outer cylinder made of polymer plastic having top and bottom openings;

a cylindrical cup insert removably disposed within the outer cylinder and having a shape to match the shape of the outer cylinder, the cup insert being made of polymer plastic and including a plurality of vented openings disposed around a central opening;

a light source removably disposed in the outer cylinder beneath the cup insert, the light source comprising a cylindrical metal base having a shape to match the shape of the outer cylinder and including a light bulb and a light bulb holder, a lens, and an o-ring gasket to seal the light source against moisture;

a connection ring disposed between the cup insert and the light source, the connection ring securing the light source to the cup insert;

the cup insert and light source being disposed within the outer cylinder such that securing the cup insert within the outer cylinder suspends the light source above the bottom opening; and a flag comprising a flag pole and a pole base, the pole base configured to engage the central opening of the cup insert through the top opening.

14. The illuminated golf cup of claim 13, wherein the cup insert further comprises a central depression formed by an inward taper and the pole base has a shape to mirror the central depression.

15. The illuminated golf cup of claim 13, wherein the light source is low voltage.

16. The illuminated golf cup of claim 13, wherein the light source includes an internal battery.

17. The illuminated golf cup of claim 13, wherein the light source is connected to an external power source by electrical wires run under the putting green and into the bottom opening of the hollow cylinder.

* * * * *